US007874117B1

(12) United States Patent
Simpson

(10) Patent No.: US 7,874,117 B1
(45) Date of Patent: Jan. 25, 2011

(54) STANDING SEAM ROOF ASSEMBLY

(75) Inventor: Harold G. Simpson, Edmond, OK (US)

(73) Assignee: Harold Simpson, Inc., Edmond, OK (US)

( * ) Notice: Subject to any disclaimer, the term of this patent is extended or adjusted under 35 U.S.C. 154(b) by 0 days.

(21) Appl. No.: 12/533,923

(22) Filed: Jul. 31, 2009

Related U.S. Application Data

(63) Continuation of application No. 11/107,498, filed on Apr. 15, 2005, now Pat. No. 7,574,839, which is a continuation-in-part of application No. 09/978,262, filed on Oct. 15, 2001, now Pat. No. 6,889,478, which is a continuation-in-part of application No. 09/059,146, filed on Apr. 13, 1998, now Pat. No. 6,301,853, which is a continuation-in-part of application No. 08/484,975, filed on Jun. 7, 1995, now Pat. No. 5,737,894, and a continuation-in-part of application No. 08/480,968, filed on Jun. 7, 1995, now Pat. No. 5,692,352.

(51) Int. Cl.
*E04D 1/00* (2006.01)

(52) U.S. Cl. ..... 52/520; 52/545; 52/748.1; 52/528

(58) Field of Classification Search ..... 52/520, 52/528, 529, 545, 547, 748.1
See application file for complete search history.

(56) References Cited

U.S. PATENT DOCUMENTS

| | | | | |
|---|---|---|---|---|
| 2,284,898 | A | 6/1942 | Hartman | |
| 3,559,359 | A | 2/1971 | Talbert | |
| 3,583,121 | A | 6/1971 | Tate et al. | |
| 3,740,917 | A | 6/1973 | Wong | |
| 3,845,930 | A | 11/1974 | Metrailer | |
| 3,998,019 | A | 12/1976 | Reinwall, Jr. | |
| 4,099,357 | A | 7/1978 | Lester | |
| 4,106,256 | A | 8/1978 | Cody | |
| 4,133,161 | A | 1/1979 | Lester | |
| 4,155,209 | A | 5/1979 | Schirmer | |
| 4,213,282 | A | 7/1980 | Heckelsberg | |
| 4,217,741 | A | 8/1980 | Cole | |
| 4,269,012 | A | 5/1981 | Mattingly et al. | |
| 4,314,428 | A | 2/1982 | Bromwell | |
| 4,329,823 | A | 5/1982 | Simpson | |
| 4,408,423 | A | 10/1983 | Lautensleger et al. | |
| 4,467,586 | A * | 8/1984 | Long et al. | 52/748.1 |
| 4,522,005 | A | 6/1985 | Seaburg et al. | |

(Continued)

*Primary Examiner*—Richard E Chilcot, Jr.
*Assistant Examiner*—Chi Nguyen
(74) *Attorney, Agent, or Firm*—Fellers, Snider, et al.; Bill D. McCarthy

(57) ABSTRACT

A standing seam formed by overlapping male and female sidelaps, the male sidelap forming a male locking tab and the a female sidelap forming a female first cavity, a female second cavity and a female third cavity, the sidelaps hook and rolled and interconnected so that a female first portion and a male first portion are substantially parallel, a female second portion and male second portion are substantially parallel, and a female third portion and male locking tab are substantially parallel, the junction of the male first and second portions is disposed in the female first cavity, the junction of the male second and third portions is disposed in the female second cavity, and the male locking tab is disposed in the female third cavity, the female third portion and male locking tab extending toward the female and male first portions.

13 Claims, 10 Drawing Sheets

U.S. PATENT DOCUMENTS

| | | | | |
|---|---|---|---|---|
| 4,528,789 | A | 7/1985 | Simpson | |
| 4,562,683 | A | 1/1986 | Gottlieb | |
| 4,597,234 | A | 7/1986 | Simpson | |
| 4,677,795 | A | 7/1987 | Mathews et al. | |
| 4,686,809 | A | 8/1987 | Skelton | |
| 4,694,628 | A | 9/1987 | Vondergoltz et al. | |
| 4,706,434 | A | 11/1987 | Cotter | |
| 4,819,398 | A | 4/1989 | Dameron | |
| 4,870,798 | A | 10/1989 | Richter | |
| 4,987,716 | A | 1/1991 | Boyd | |
| 5,038,543 | A | 8/1991 | Neyer | |
| 5,142,838 | A | 9/1992 | Simpson et al. | |
| 5,201,158 | A | 4/1993 | Bayley et al. | |
| 5,241,785 | A | 9/1993 | Meyer | |
| 5,303,528 | A | 4/1994 | Simpson et al. | |
| 5,379,517 | A | 1/1995 | Skelton | |
| 5,524,409 | A | 6/1996 | Kaiser | |
| 5,715,640 | A * | 2/1998 | Haddock | 52/545 |
| 5,737,894 | A | 4/1998 | Simpson et al. | |
| 6,301,853 | B1 | 10/2001 | Simpson et al. | |
| 6,889,478 | B1 | 5/2005 | Simpson | |
| 7,574,839 | B1 * | 8/2009 | Simpson | 52/520 |

* cited by examiner

STANDING SEAM ROOF ASSEMBLY

RELATED APPLICATIONS

The present application is a continuation application of U.S. patent application Ser. No. 11/107,498 filed Apr. 15, 2005, which is a continuation-in-part of U.S. patent application Ser. No. 09/978,262 filed Oct. 15, 2001, which is a continuation-in-part of 09/059,146 filed Apr. 13, 1998, now U.S. Pat. No. 6,301,853 issued Oct. 16, 2001. U.S. Pat. No. 6,301,853 is a continuation-in-part of U.S. patent application Ser. No. 08/484,975 filed Jun. 7, 1995, now U.S. Pat. No. 5,737,894 issued Apr. 14, 1998, and of U.S. patent application Ser. No. 480,968 filed Jun. 7, 1995, now U.S. Pat. No. 5,692, 352 issued Dec. 2, 1997.

FIELD OF THE INVENTION

The present invention relates to a roof assembly for a building structure, and more particularly, but not by way of limitation, to an improved standing seam roof assembly.

BACKGROUND

Numerous types of roof assemblies have previously been proposed for pre-engineered buildings in efforts to provide a watertight roof assembly, while also enabling the roof assembly to expand and contract as changes in temperature are encountered. One such prior art roof assembly of considerable success in recent years is the standing seam roof assembly.

The panel members of a standing seam roof assembly are joined along lapped together side edges forming the standing seams. The panel members are secured to secondary structural members by either clips or through fasteners. The clips used to attach the standing seam are of two types: floating (one or two piece moveable); and fixed (one piece with no movement allowed between the panel and the supporting structure). Through fasteners, when employed, penetrate the panels and attach the panels to underlying support structure to substantially lock the panels and support structure together so that differential movement is restricted. Roofs may be classified as shed roofs and sloped gasket roofs. Shed roofs shed water because gravity pulls the water down and away from panel joints more effectively than wind or capillary action propel water thought the joint. Shed roofs generally occur over slopes of three to twelve or greater. Sloped gasket roofs, on the other hand, provide roof joints that are made watertight by placing gasket material between the panel joints and securing the gasket material in place by, for example, encapsulating or exerting pressure on the gasket material such as by seaming. Generally, sloped gasket roofs have a ¼ to twelve slope or greater.

Heretofore, field seamed gasket joints in large roofs have generally been limited to two-piece clips in which movement between the roof and the underlying structure occurred within the clip. The reason for this is that, in the past, the top hook portion of the clip intersected the gasket sealant, and if the clip hook moved in relation to the panel which held the sealant, the movement of the clip hook deformed and destroyed the gasket seal. Single piece clips have been used freely in small and shed roofs where gasket sealing is not required.

If floating clips or flexible framing are not used, the repeated action of expansion and contraction of the panel member tend to weaken the panel-to-panel lap joints and the panel to framing connection, causing separation, structural failure and roof leakage. Leaks are generally caused by the weakening of the fastening members and working or kneading of the sealant disposed at the joints. Thus, sealants for such roof assemblies have required the qualities of adhesion, flexibility and water repellence. Further, in many instances the pressure on the sealant can vary greatly throughout the length of the sidelap and end lap joints of the panels, resulting in uneven distribution and voids in the joint sealant.

Many of the problems encountered with prior art standing seam roofs, such as structural failures and leaks, are overcome by the standing seam floating roof assembly taught by U.S. Pat. No. 5,737,894 issued to Harold G. Simpson and Leo E. Neyer. The standing seam floating roof assembly is formed of elongated metal panels, each of which is provided with a female member formed along one longitudinal edge and a male member formed along the opposed longitudinal edge. Adjacently disposed panels are joined by interlocking female and male members to form the standing seam joint. Clips interconnect the standing seam joints and the supporting structure, with the upper portions of the clips hooking over the male members of the panels. Most such clips are of the sliding type which permit the hooking portions to move relative to supporting base portions connected to the supporting structure, while relative motion between the clip hooks and the metal panels is substantially prevented. A sealant material is disposed to form a moisture dam in the interlocking joints of the female and male members.

In addition to standing seam roof assemblies used in newly constructed pre-engineered buildings, standing seam roof assemblies are also finding increased usage in another segment of the roofing industry, that of the replacement of built-up roofs. Generally, a built-up roof is formed of a plurality of interconnected sections that are sealed by a watertight over coat of asphaltic composition. Such built-up roofs have generally performed well, but problems can be expected with age; from building settlement; and from standing water pockets resulting from construction errors. Standing water usually results in deterioration of the roof, resulting in leaks and other problems.

There remains a need for improved standing seam roof assembly having improved integrity of strength and water tightness performance.

SUMMARY OF THE INVENTION

A standing seam roof assembly in which overlapping sidelap edges of adjacent panel members are joined in an assembled mode to provide a standing seam having a female sidelap along one edge and a male sidelap along the opposite edge, the female sidelap having a male insertion cavity and a leg member with a female retaining groove. The male sidelap, engagable in the male insertion cavity of an adjacent panel, has a tang lockingly disposed in the female retaining groove in folded tight adjacency to form a standing seam between panels.

That is, the standing seam is formed by overlapping male and female sidelaps of the adjacent panels, the male sidelap forming a male locking tab and the female sidelap forming a female first cavity, a female second cavity and a female third cavity (also referred to as a female retaining groove).

The sidelaps are hook and rolled to interconnect so that a female sidelap first portion and a male sidelap first portion are substantially parallel, a female sidelap second portion and male sidelap second portion are substantially parallel, and a female sidelap third portion and male sidelap locking tab are substantially parallel, the junction of the male sidelap first and second portions is disposed in the female first cavity, the junction of the male sidelap second and third portions is disposed in the female second cavity, and the male sidelap locking tab is disposed in the female third cavity, the female sidelap third portion and male sidelap locking tab extending toward the female and male first portions.

The features, benefits and advantages of the present invention will become apparent from the following detailed description when read in conjunction with the drawings and appended claims.

DETAILED DESCRIPTION

In conventional standing seams, the standing seam clip bears only on the male seam portion of the panel inserted into the adjacent female seam portion. The female seam portion is not retained directly by the clip, and as a result, the load from the female seam portion must pass through the male seam portion and into the clip where the load can, in turn, pass to the secondary structural. This action tends to "unravel" or "unzip" the panel joint and allows distortions over the short section retained by the clip. This has resulted in premature panel failure from wind uplift.

A roof panel is usually attached to underlying supporting structure in a manner that causes the panel to act as a three or four span continuous beam. This arrangement substantially reduces the maximum moment occurring at any one point compared to the moment that would occur in a simple beam, other factors being equal. However, this can cause a negative moment to occur at the attachment point. This negative moment peaks and drops off very quickly as the panel section moves from the center line of the attaching clip towards the point of inflection (P.I.), the point where the moment in the panel changes from positive to negative.

Figure 1:
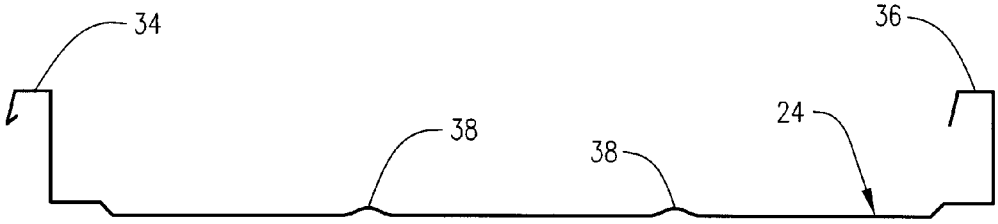
FIG. 1 is an end view of the profile of a roof panel member.
Figure 2:
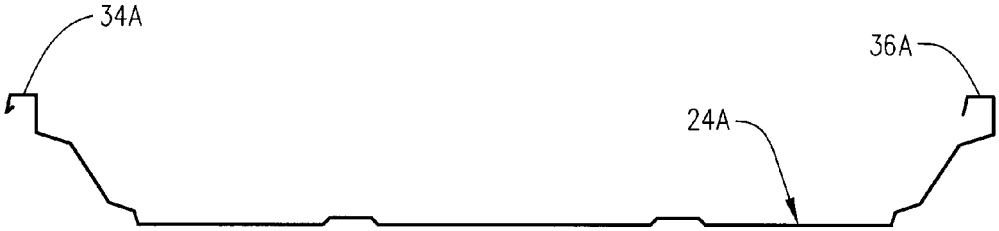
FIG. 2 is an end view of the profile of an alternative roof panel member.

Shown in FIG. 1 is a roof panel 24 that has a substantially flat pan profile between a female sidelap portion 34 and a male sidelap portion 36. The medial portion of the roof panel 24 can have a number of corrugations 38 of a selected height for the purpose of stiffening the panel. FIG. 2 shows an alternative roof panel 24A having trapezoidal sidelap portions 34A, 36A to improve the panel material utilization in relation to roof coverage. That is, all else being equal, the roof panel 24 of FIG. 3 requires a wider metal blank sheet than does the roof panel 24A of FIG. 4.

Figure 5:
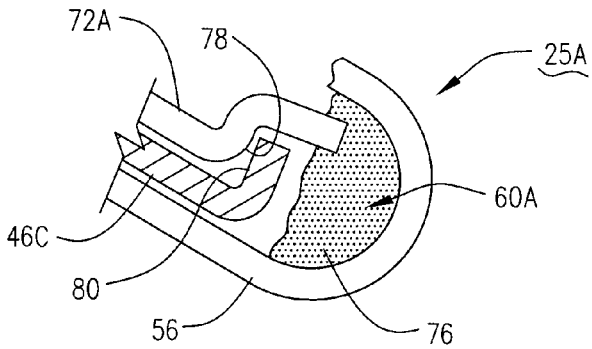
FIG. 5 is an elevational view of a portion of the standing seam assembly of FIG. 4, showing an alternative configuration of the male sidelap portion and the retaining clip.

Adjacent roof panels 24 are interlocked with the female sidelap portion 34 wrapped around the male sidelap portion 36, as shown in FIG. 5. It will be noted that outwardly angled leg 40 of the female sidelap 34 is provided with a hook 42 at its a distal end for sliding engagement past a tang portion 44 of the male sidelap 36 as the two adjacent roof panels 24 are joined. In this manner, the panel profile of the present invention provides for an ease of initially assembling and interlocking the male sidelap 36 with the female sidelap 34; that is, the female sidelap 34 can be dropped vertically onto the male sidelap 36. This provides a superior method of joining panels in comparison to the roll-to-lock method wherein one panel is rotated upwardly in order to interlock and then rotated downwardly into a final position.

Figure 3:
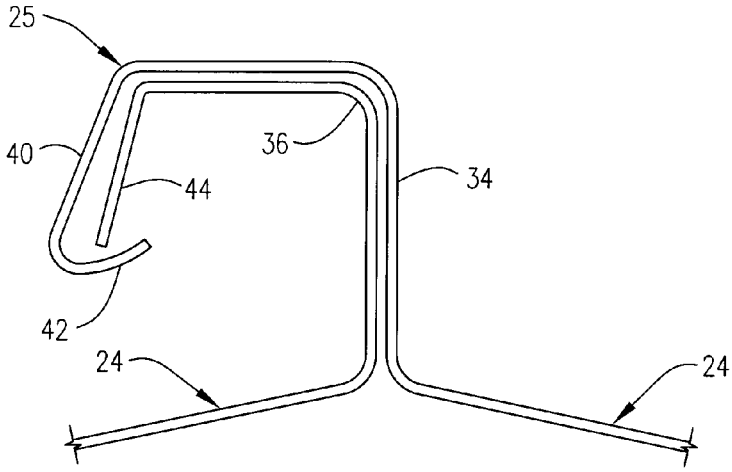
FIG. 3 is an end view of the profile of a portion of the male sidelap portion interlocked with a portion of the female sidelap portion of the roof panel members of FIG. 2.

FIG. 3 shows interlocked adjacent roof panels 24 forming the standing seam 25 in an unseamed condition; that is, once interlocked as shown, mechanical seaming can be used on the standing seam 25 to provide the final relationship between the male sidelap portion 36 and the female sidelap portion 34. An attachment clip can also be gripped between the male sidelap portion 36 and the female sidelap portion 34 for attachment to the underlying roof structure, as will be discussed below.

Figure 4:
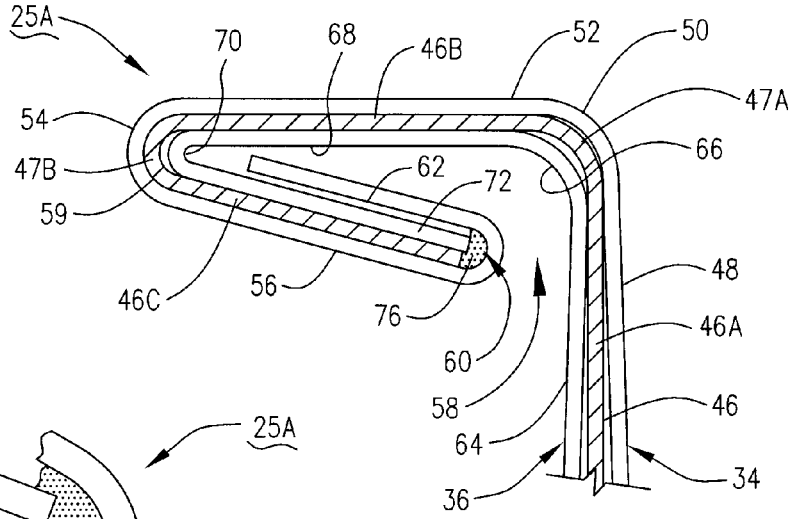
FIG. 4 is an elevational view of a standing seam assembly between adjacent panels in the final formed configuration.

FIG. 4 shows a standing seam 25A, which is identical to the standing seam 25 of FIG. 3 with the exceptions that the upper portion of a roof clip 46 is sandwiched between the female sidelap 34 and the male sidelap 36, after which the standing seam 25A has been field formed by a seaming operation. It will be understood that the roof clip 46 has a lower portion that extends beneath the roof panels 24 and is connected to the building support structurals, such as the secondary structural system 20.

The female sidelap 34 has a female first leg member 48, a female first radiused portion 50, a female second leg member 52, a female second radius portion 54 and a female third leg member 56 which together form a female first cavity 58 and a female second cavity 59 (also sometimes herein referred to as the first and second male insertion cavities, respectively), for receiving the male sidelap 36. A female third cavity 60, also referred to herein as the female retaining groove 60, is disposed at a distal end of the female third leg member 56, an extended female fourth leg portion 62 (the hook 42 in FIG. 3) extending from the female third leg member 56 to form the female third cavity, or female retaining groove, 60.

The male sidelap 36 has a male first leg member 64, a male first radius portion 66, a male second leg member 68, a male second radius portion 70 and a male third leg member 72, also referred to as the male tang member 72, disposed in the female first cavity 58. The male second radius portion 70 is disposed in the female second cavity 59, and a distal end of the male tang member 72 is disposed in the female retaining groove 60.

The roof clip 46 has a clip first leg member 46A; a clip second leg member 46B; a clip third leg member 46C; the roof clip 46 also has a clip first radius portion 47A and a clip second radius portion 47B, as shown. For clarity of presentation, the numerical designation of the roof clips in the appended figures will all be designated by the number 46, even though there are some variations in the geometrical configurations of the roof clips. Furthermore, the roof clip 46 in each of the figures will be cross-hatched to aid in distinguishing the assembled components of the various embodiments of the standing seams described herein.

In FIG. 4, the roof clip 46 is sandwiched between the female sidelap 34 and the male sidelap 36. The clip first radius portion 47A is shaped to conform to the curvature of the female first radius portion 50 and the male first radius portion 66. The clip second radius portion 47B lockingly engages the male second radius portion 70 in the female second cavity 59, the roof clip 46 thereby attaching the male sidelap 36 to the underlying building structural system.

The distal end of the clip third leg member 46C is lockingly engaged in the female retaining groove 60 formed by the female third leg member 56 and the female fourth leg member 62. A mastic material 76 is disposed in the female retaining groove 60 to sealingly engage the distal end of the male tang member 72 of the roof clip 46, thereby providing a watertight seal for the standing seam 25A.

In the installed mode of the standing seam 25A after field seaming, as depicted in FIG. 4, the standing seam 25A has a triple lock integrity. That is, the standing seam 25A formed by the interlocking engagement of the female and male sidelaps 34, 36 is secured by the male first radius portion 66 in the female first radius portion 50; the male second radius portion 70 in the female second radius portion 54; and the male third leg member, or the male tang member, 72 in the female retaining groove 60.

In addition to the aforementioned locking engagements of the standing seam 25A, the male tang member 72 acts as a locking tab that engages the female retaining groove 60 to resist unfurling or unzipping by uplift forces. As the panels forming the standing seam 25A are subjected to uplift forces, such as by wind, pivoting disengagement is attempted by the separation of these members, and as this occurs, the male tang member 72 and female retaining groove 60 permit some upward flexing of the adjacent roof panels 24 while maintaining the latching integrity of the sidelap portions 34, 36 and closure of the standing assembly 25A.

FIG. 5 shows a portion of an alteration to the standing seam 25A of FIG. 4, wherein the female retaining groove 60 contains a mastic 76, but in this embodiment, only the male tang member 72A is sealingly engaged by the mastic 76, and not the proximal end of the clip third leg member 46C. The male tang member 72A forms a shoulder 78 which pressingly engages an opposing shoulder 80 formed at the proximal end of the clip third leg member 46C. In this manner the roof clip 46 abuttingly engages the male sidelap 36 to provide a positive support thereof. This positive engagement of the roof clip 46 against the male tang member 72A reduces the amount of field seaming required to form the standing seam assembly 25A. Thus, the female retaining groove 60A can be preformed, and the male sidelap 36 and the roof clip 46 simply assembled together and placed into the female retaining groove 60A. Such assembly simplifies installation by reducing the field seaming operation to one simple bend of the assembly at radii 54, 70, and 47B.

Another advantage provided by the roof-clip 46 not being engaged by the mastic 76 is that the roof clip 46 can float without disrupting the seal with the mastic 76. This advantage of this will become clear from the discussion of a two-piece roof clip that follows below.

Figure 6:
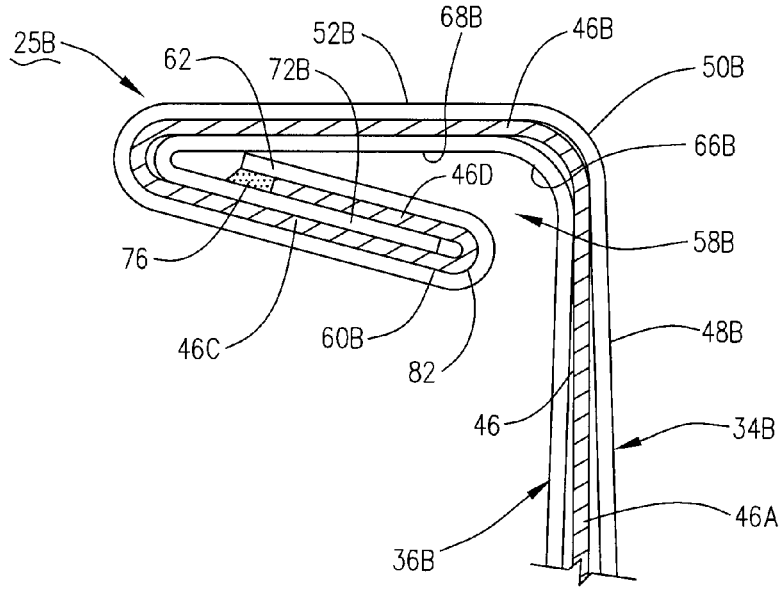
FIG. 6 is an elevational view of an alternative preferred embodiment of the standing seam assembly of FIG. 4.

FIG. 6 shows a standing seam 25B in which, like the standing seam 25A of FIG. 4, the female second leg member 52B is substantially perpendicular to the female first leg member 48B. Here, however, the roof clip 46 is formed to have a retaining groove 82 in which the proximal end of the male tang member 72B of the male sidelap 36B is disposed; and wherein the retaining groove 82 is positioned in the female retaining groove 60B of the female sidelap 34B. In this embodiment, the end of the female fourth leg member 62 is contiguous to the end of the clip fourth member 46D, and the mastic 76 is placed to seal the ends of the female sidelap 34B and the roof clip 46 (in addition to, or in lieu of, being placed in the female retaining groove 60B).

Figure 7:
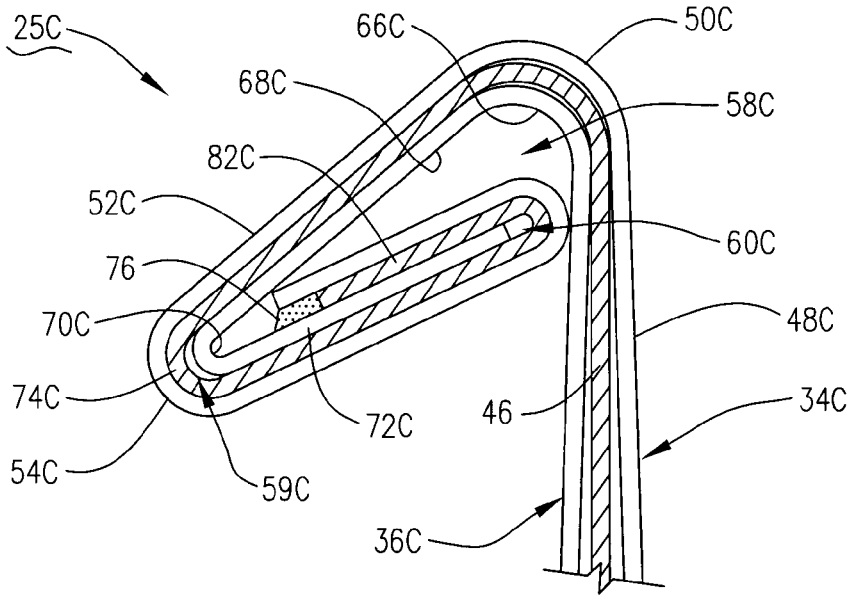
FIG. 7 is an elevational view of an alternative preferred embodiment of the standing seam assembly of FIG. 4.

FIG. 7 shows another embodiment of a standing seam 25C wherein the standing seam 25B of FIG. 6 has been further seamed or rotated downwardly to create an acute angle with respect to the female first leg member 48C. The standing seam 25C provides a tighter and stronger, more watertight seam, because the over-bending of the male and female sidelaps 36C, 34C and the roof clip 46 requires a longer arc length for female first radius portion 50C, and this draws the female retaining groove 60C very tightly against the male tang member 72C.

Figure 8:
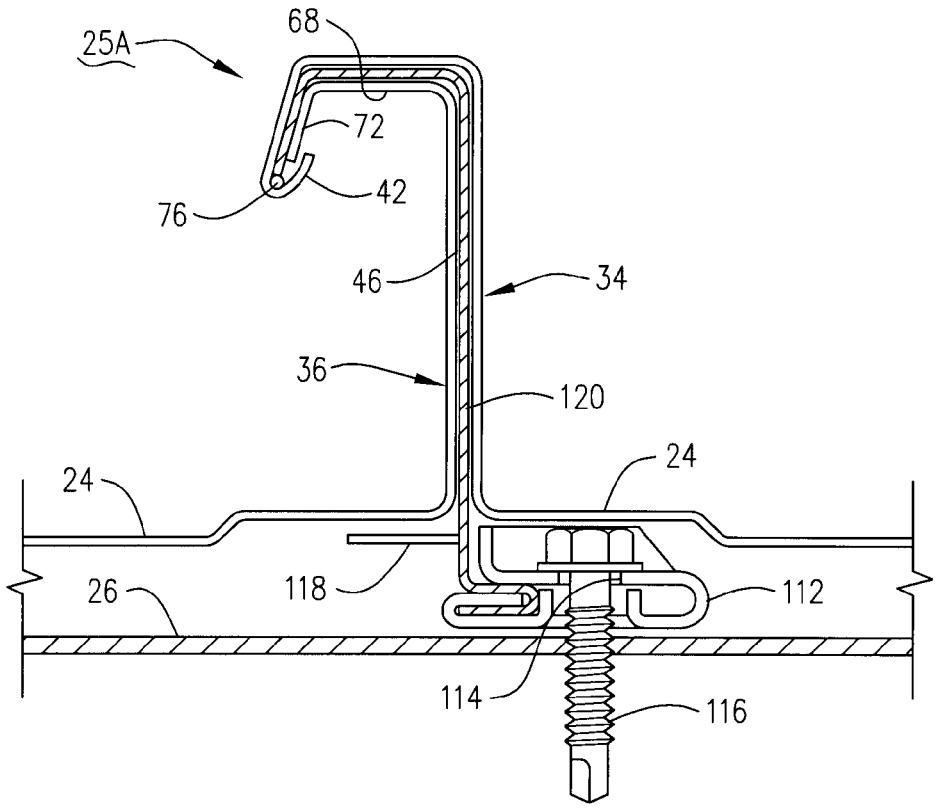
FIG. 8 is an elevational view of an alternate standing seam assembly of FIG. 4 before the field seaming operation is performed.

FIG. 8 shows the standing seam 25A of FIG. 4 in an unseamed condition. During assembly, the roof clip 46 is placed over the male sidelap 36, and the female sidelap 34 is then placed over both. In this manner, the hook 42 of the female sidelap 34 is deflected as it passes by the male tang member 72 (of the male sidelap 36) and is positioned there below. It will be noted that the mastic material 76 is supported within the female sidelap 34 before field seaming.

The roof clip 46 as shown in FIG. 8 is of a two-piece construction having an attachment end 112 with an aperture 114 through which a fastener 116 is attached in threading engagement with the underlying structure, such as in the attachment of the roof clip 46 to the panel support assembly 26 (or directly to the bar joist 22). The roof clip 46 has a support shelf 118 for supporting the male sidelap 36 during the assembly and seaming of the standing seam 25A. Further, the roof clip 46 has an upstanding web portion 120 which supports the male tang member 72 at an end portion thereof.

In the seaming operation it is necessary to prevent the edge of the hook 42 of the female sidelap 34 from distorting in a manner that creates a scalloped edge. Such a scallop increases the effective width of the seamed joint which, if too wide, will interfere with the forming of the desired included angle of the female second radius portion 54 (FIG. 9) because the scalloped edge of the hook 42 (of female fourth leg member 62) will contact the male second leg member 68 (of male sidelap 36).

Figure 9:
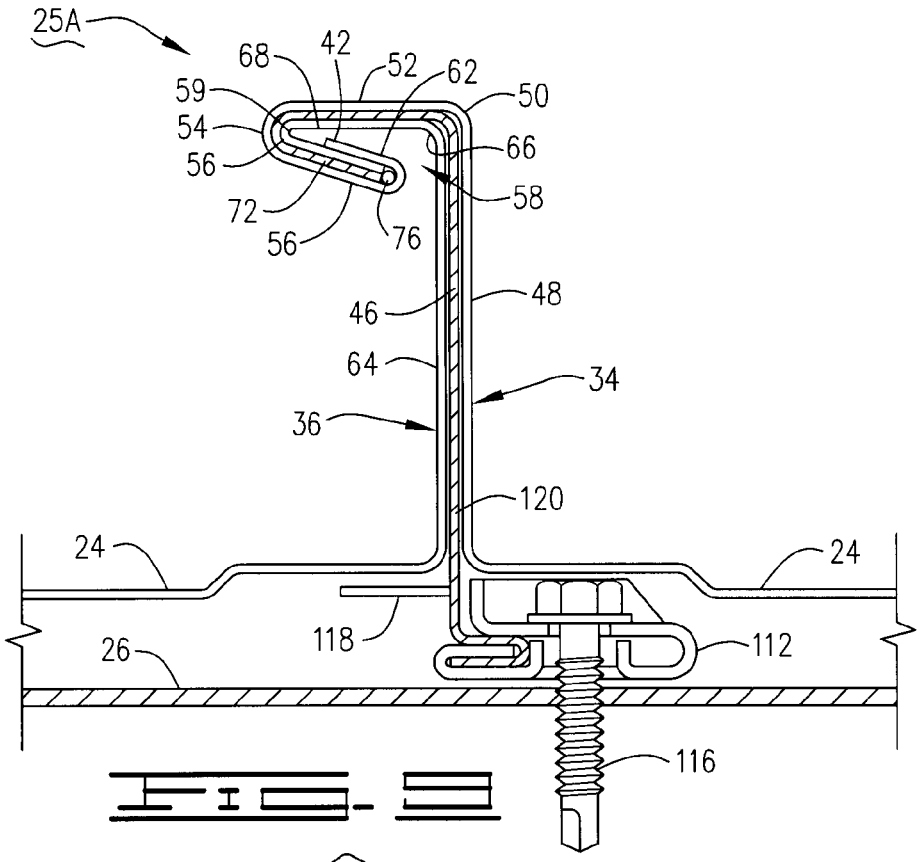
FIG. 9 is an elevational view of a standing seam assembly of FIG. 4 after field forming and attachment to the underlying roof structure.

To prevent the scalloped edges and interference it is possible to pre-crimp the hook 42 against the male tang member 72 before forming the desired included angle within the female second radius portion 54. While FIG. 9 shows the standing seam 25A in its final seamed position and attached to the underlying panel support assembly 26, it will be understood that the angular disposition of the legs 52, 56, 62 (of the female sidelap 34), the legs 68 and locking tang 72 (of the male sidelap 36) and the corresponding legs of the clip 46 can be angularly determined during the seaming process as desired and can be angularly disposed such as that depicted in FIG. 7.

Figure 10:
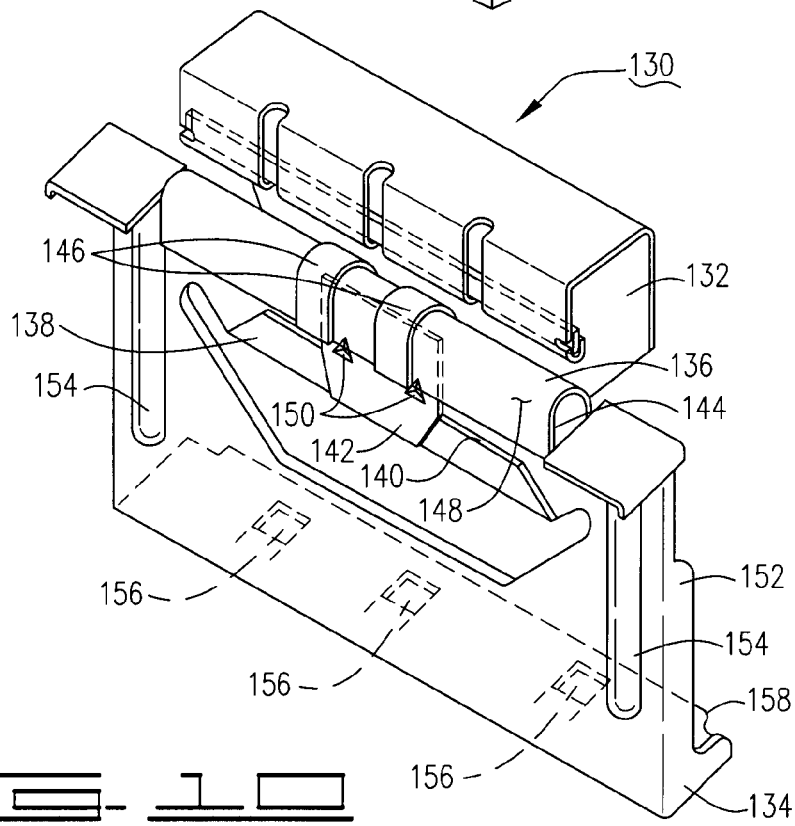
FIG. 10 is an isometric view of a two-piece roof clip assembly.

FIG. 10 shows a two-piece roof clip 130, which has a hold down clip tab 132 as well as a clip base 134 to which the hold down clip 132 is attached. The clip base 134 has a beam section 136 and an upwardly pointing flange portion 138 having a top flange surface 140. The beam section 136 and flange portion 138 slidingly support the hold down clip tab 132 to limit vertical movement thereof, and to provide for longitudinal movement of the hold down clip tab 132 relative to the clip base 134 along the beam section 136. More particularly, the hold down clip tab 132 has a first tab member 142 that slidingly engages an inside surface 144 of the beam section 136, and a pair of second tab members 146 that slidingly engage an opposing outer surface 148. A pair of third tab members 150 extend from the first tab member 142 and slidingly engage the top flange surface 140. In this manner, the top flange surface 140 provides a track on which the hold down clip 132 slides in a longitudinal direction.

Figure 11:
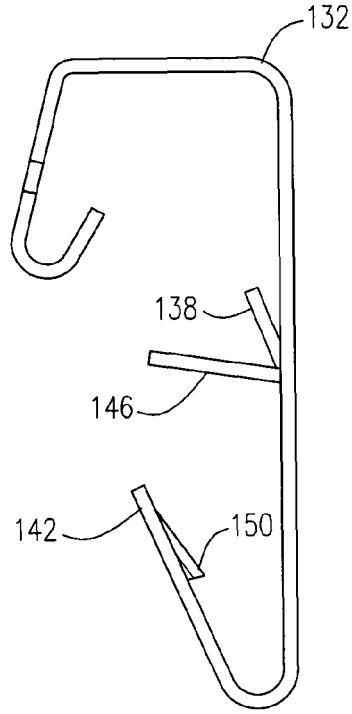
FIG. 11 is an end view of the hold down clip portion of the two-piece clip assembly of FIG. 10.
Figure 12:
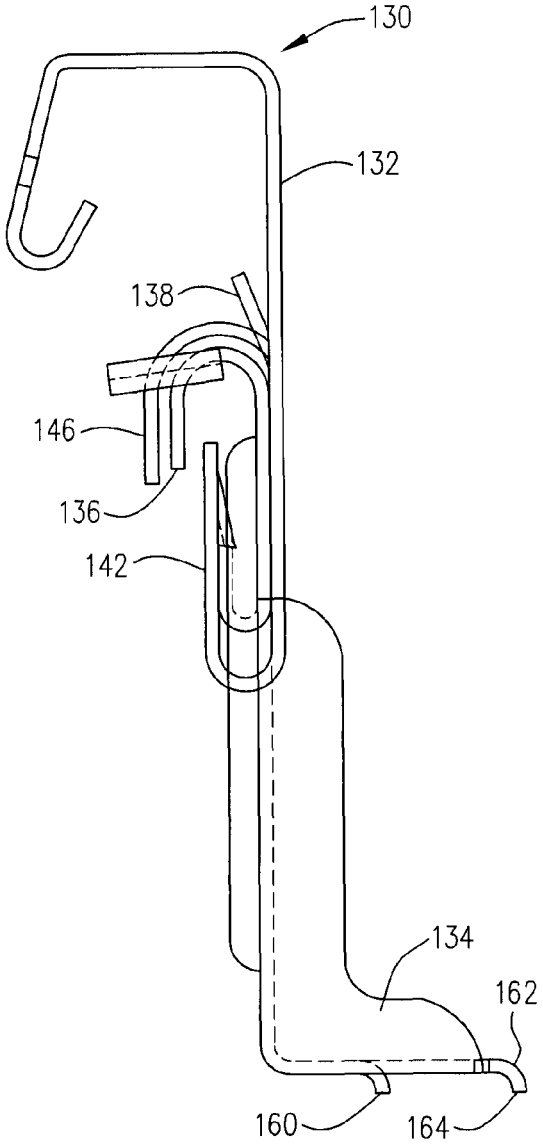
FIG. 12 is an end view of the two-piece roof clip assembly of FIG. 10.

FIG. 11 shows the hold down clip 132 before being installed to the clip base 134, which is accomplished by inserting the first tab member 142 and the second tabs 146 around the beam section 136 of the clip base 134. The first tab member 142 is formed upward and its end placed inside the beam section 136. The second tabs 146 are formed downward to engage the beam section 136 in opposition to the first tab member 142. FIG. 28 shows the hold down clip tab 132 installed in this manner on the clip base 134.

The clip base 134 can be formed from a single piece of sheet metal formed as shown so as to include rib sections 152 and embossments 154 to provide additional strength and resistance to distortional forces upon the clip base 134.

Figure 13:
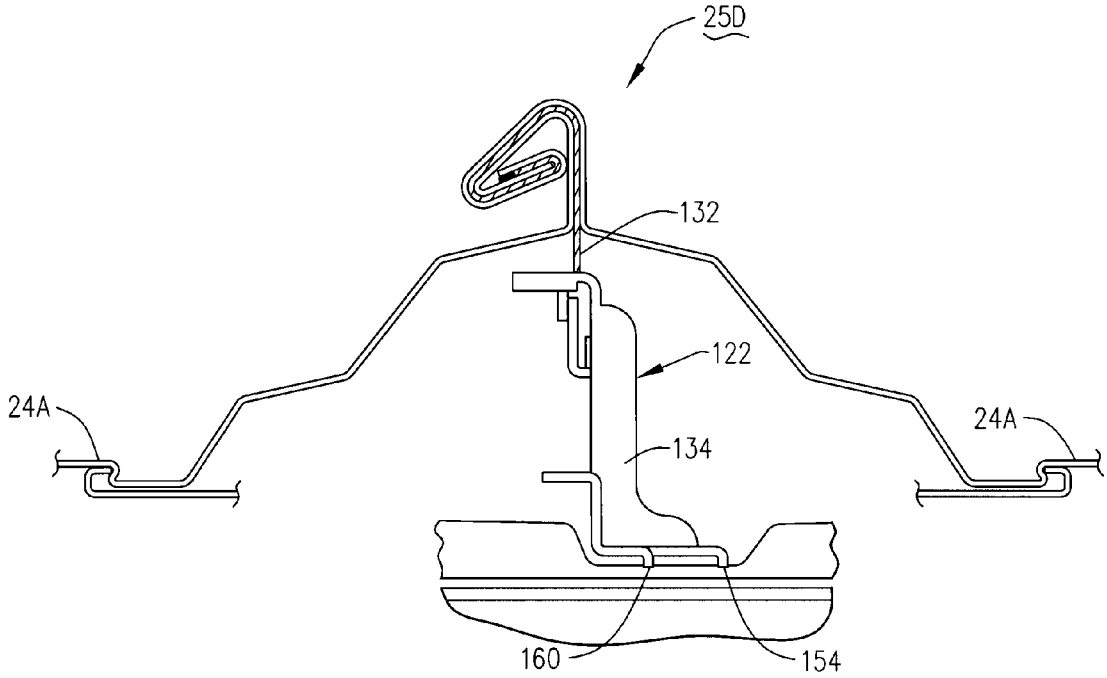
FIG. 13 is an elevational view of the roof system of the present invention, employing the roof members of FIG. 2 attached to the underlying roof structure by the two-piece roof clip of FIG. 10.

The clip base 134 is anchored to the underlying structure, such as a purlin, as depicted in FIG. 13, by conventional fasteners (not shown). More particularly, the fasteners are placed through openings 156 (FIG. 10) in a bottom facing flange 158 of the clip base 134. To provide a solid connection of the base over thermal insulation above the purlin, the flange 158 is formed with feet 160 that extend downwardly at an angle substantially normal to the flange 158 and which thereby easily compress the thermal insulation so as to bear solidly on the purlin. The feet 160 are formed by punching rectangular holes or openings through the flange 158 and forming the metal of the openings downward. Additionally, a back edge 162 of the flange 158 is formed downwardly to provide a foot 164 that acts in cooperation with the feet 160 to support the flange 158.

Finally, FIG. 13 shows the standing seam 25D formed of overlapping adjacent panels 24A having trapezoidal sidelap portions and secured to the underlying roof structure with the two-piece roof clip 130 of FIG. 10. It will be noted that all of the exemplary configurations of the standing seam 25 discussed herein above can be used with either flat pan or trapezoidal sidelap portions, and with either the one-piece roof clip 46 or the two-piece roof clip 122.

Figure 14:
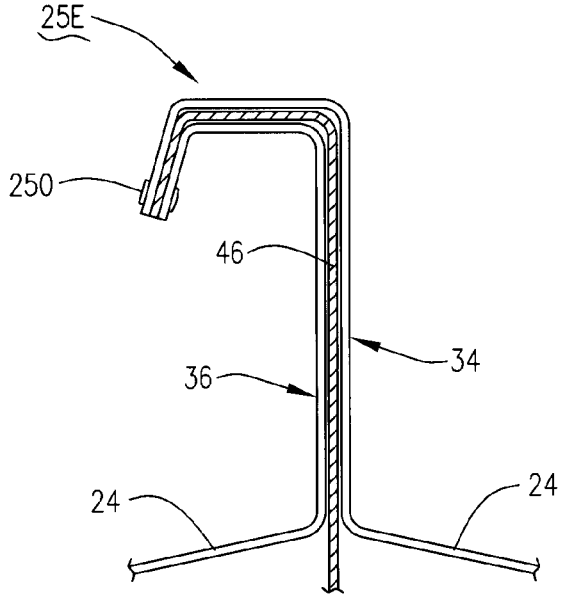
FIG. 14 is an end view of yet another alternative standing seam with a clip tab between the male and female corrugation with a fastener inserted through the male and female seam.
Figure 15:
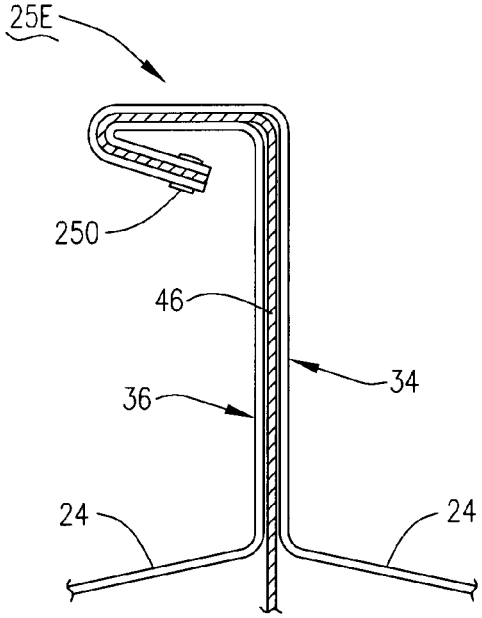
FIG. 15 is an end view of the standing seam of FIG. 14 after the corrugation has been seamed to tighten the seam and hide and protect the fastener.

FIG. 14 is an end view of a standing seam 25E with the clip tab 46 between the male sidelap 36 and female sidelap 34, and having a fastener 250 inserted through the male and female sidelaps. With this configuration, the seam and clip tab prevent in-plane shear movement between all three elements. Illustrated as a rivet in FIG. 46, the fastener 250 also increases the seam resistance to unfurling when subject to uplift forces. The fastener 250 is located outside (outboard) of the sealant (not shown) so water tightness of the seam is not impaired, and is applied through the last element to make the fastener 250 easy to apply. FIG. 15 is an end view of the standing seam of FIG. 46 after the corrugation has been seamed to tighten the seam and hide and protect the fastener.

Figure 16:
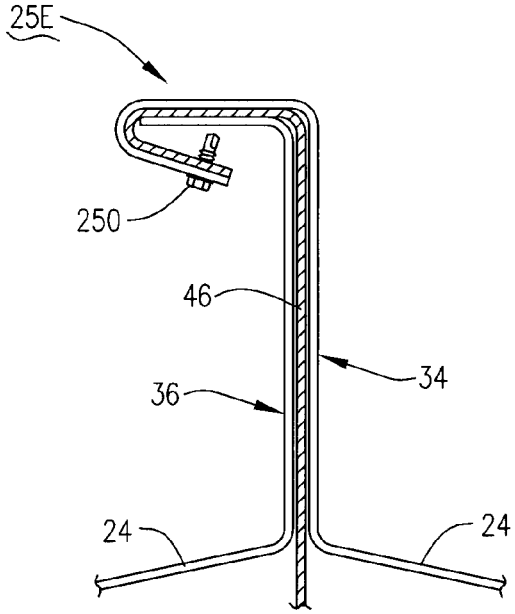
FIG. 16 is an end view of an alternative standing seam with a fastener.

FIG. 16 shows an alternative standing seam fastener 252 attaching any two of the three elements (the male and female sidelaps and the clip) to increase in-plane shear resistance between any two of the elements as required and to increase resistance to unfurling. The fastener 252 is preferably a self tapping, self threading screw member.

A roof panel is usually attached to underlying supporting structure in a manner that causes the panel to act as a continuous beam. This arrangement substantially reduces the maximum moment occurring at any one point compared to the moment that would occur in a simple beam, other factors being equal. However, this means of construction causes a negative moment to occur at the attachment point. This negative moment peaks and drops off very quickly as the panel section under consideration moves from the center line of the attaching clip towards the point of inflection (P.I.), the P.I. being that point where the moment in the panel changes from positive to negative.

Past center hold-down practice has been to coordinate such usage with edge hold-down practice so that if through fasteners were used to attach the center of the panel to the underlying structural, then fixed clips or through fasteners were used to attach the edge of the panel to the underlying structural; and conversely, if the panel edge attachment consisted of a floating, (two-piece, moveable) non-penetrating attachment means, such as a clip, then the center hold-down was either totally eliminated or a floating, non-penetrating center hold-down device was utilized. However, past non-penetrating center hold devices heretofore have largely been ineffective and expensive.

The effectiveness of non-penetrating center hold-down clip devices is influenced by the number and height of corrugations formed in the panel and the width, thickness and strength of the metal laterally separating the corrugations. The configuration and number of panel corrugations in turn has a direct impact on the efficiency of material utilization, which in turn is a primary cost factor. Conventional standing seam roofs can only achieve a flat-width-to-coverage ratio as low as 1.25:1 where through fasteners exist only at panel end laps and do not occur at the panel centers. On the other hand, non-standing seam panels with center hold-down fasteners are commonly 36" wide and can achieve flat-width-to-coverage ratios as low as 1.17:1.

Figure 17:
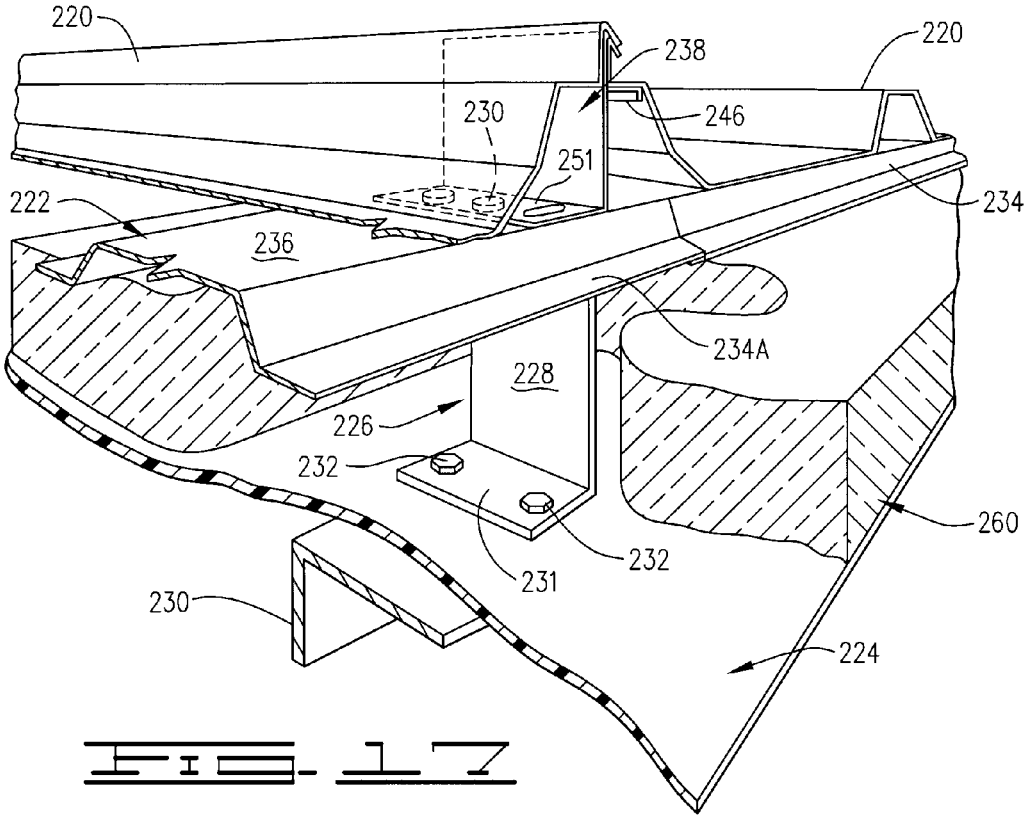
FIG. 17 is a perspective partial cross-sectional view of a standing seam roof assembly.

Shown in FIG. 17 is a portion of a roof system supported by a preexisting roof of a building structure. The preexisting roof of the building structure can be any preexisting roof structure, such as a built-up roof, which is connected to and supported by conventional elements, such as a primary and secondary structural systems (not shown). The primary structural system of a building structure will usually consist of a plurality of upwardly extending column members which are rigidly connected to a foundation and a plurality of primary beams which are generally horizontally disposed and supported by column members. The secondary structural system will usually consist of a number of purlin or joist members supported by the column members or other members, such as primary beams.

Roof panels 220 are supported on support assemblies 222 that are attached to the upper beam 230 of a roof support spacers. The roof panels 220, only portions shown, are depicted as being standing seam panels, with interlocking edge seams supported by clip portions of the panel support assemblies 222, as will become clear below.

A conventional, standing seam roof panel, on the average, is about 35 long and about 16 to 24 inches wide, although other lengths and widths are known. Typically, a standing seam roof panel member is made of 24-gauge sheet metal material, and because of this relative thin metal, corrugations are commonly formed running lengthwise in the panel to provide sufficient strength for load bearing. Further, typical prior art standing seam roof panels are secured at the interlocking sidelap joints and at the end overlap of contiguous panels.

Fastener penetration of the panels, except at the end overlaps, is generally avoided in large roofs having relatively fixed support systems in order to minimize leakage points. The reason for this is that with the connection of the panels directly to relatively rigid underlying structural members, thermal expansion has caused the panels to rip out around the fasteners. When used on short spans, or flexible secondary structural members, this usually does not occur, and the advantages of through center fasteners and an unsupported standing seam joint can be used advantageously. The medial portions of the panels located between standing seam joints are not normally secured to the underlying structural members. Such roof panels are inherently laterally flexible but longitudinally inflexible. Because the panels are usually disposed to extend transverse to the roof, if the panels are joined rigidly end to end and attached rigidly to underlying secondary structures and portions of the underlying structures are rigid, much damage can be caused by differential movement between the two.

The panel width and material thickness are dictated by the structural configuration of the panel and its support structure, as well as the inwardly and outwardly directed load requirements imposed by regulatory, insurance and good engineering practices. Other factors being equal, the material thickness that is required is normally greater for outwardly directed load than for inwardly directed load. The reason is that the panel is more fully supported by the underlying secondary supports for inwardly directed load than for outwardly directed load. The support points, other than at panel ends, for outwardly directed load were in the past located only at points of attachment of the panel of the secondary structural. Past practices limited these points of attachment to places such as those where the panel edge points pass over secondary structural members and where attachment could be made without causing additional holes in the panel.

Attempts have been made to devise intermediate corrugation and corresponding clips to hold the center of the panel to the underlying structural, but such attempts have had limited success because the outwardly directed force bows the center of the panel outward as load is applied and causes the clip to become disengaged. As will be discussed more fully below, the present invention provides for attachment of medial panel portions to underlying structural members when subjected to uplift loads, while maintaining equivalent panel quality, of using thinner gauge material and wider panels while at the same time eliminating ripping of the panel around fasteners so as to reduce roof leak potential and the adverse effects of differential expansion and contractions. This presents considerable benefit in time and cost savings to the pre-engineered building art.

Continuing this discussion with reference to FIG. 17, a flexible membrane 224 is extended substantially tautly over an appropriate structural support member such as a box joist beneath the panel support assemblies 222 and secured thereby to the upper beams 230. A layer of compressible insulation, such as insulation 260, is supported by the flexible membrane 224 such as a built up roof membrane beneath the roof panels 220 in substantially its pre-installed state. As for the type of blanket insulation 260 to be used, it will be noted that such insulation is usually a laminated product that comprises a layer of compressible mineral insulation or chopped glass fiber insulation which is bonded via an adhesive to a flexible facing membrane. However, other types of insulation, such as blown shredded paper, glass fibers and foam, may be used advantageously. The flexible membrane 224 may consist of one or more thin layers of materials such as aluminum foil or vinyl plastic which serves to provide a vapor barrier for the building envelope. A typical blanket insulation is a laminated facing membrane made of a layer of vinyl, a layer of fiberglass scrim, and a layer of aluminum foil. Bonded to the facing membrane is a thick layer of compressible fiberglass material.

The flexible membrane 224 may also be a separate, independent structural member which provides a continuous membrane vapor barrier and also serves as a support platform for the insulation layer 260. An independent membrane preferably will be a steel or aluminum sheet or a facing flexible facing membrane about one to two mils in thickness with an embedded scrim, such as Fiberglass or nylon, capable of taking tensile load. The flexible membrane 224, if separate to the insulation, is placed over the upper beams 230 by attaching it between convenient support members, such as a building wall or roof structurals, so that the membrane extends substantially taut there between. Once the membrane is tautly in position, the insulation 260 is simply placed upon the membrane.

The panel support assembly 222 shown in FIG. 17 comprises a plurality of base clips 226 each of which has a median web portion 228. At the lower end of the median web portion 228 there is formed a leg portion 230 through which self-drilling/self-tapping screws 232 extend to secure the base clip 226 to the underlying support spacers 226. As shown in FIG. 3A, the attachment of the base clips 226 serve to secure the flexible membrane 224 to the top of the upper support spacers.

The panel support assembly 222 also comprises a plurality of panel support beams 234 that are generally elongated channel shaped members arranged in overlapping, end-to-end relationship. As shown, the panel support beams 234 extend generally parallel to the underlying upper beams 230, but where desired, the panel support beams can be disposed to run perpendicularly to, or otherwise angularly to, the underlying upper beams 230. Preferably, the base clip 226 is formed as an integral portion of the panel support beam 234 to which it is attached. That is, each of the base clips 226 is formed as an extension of the web portion of its channel shaped panel support beam 234 and is press formed to extend downwardly there from to support one end of its respective panel support beam 234 at a predetermined distance above the underlying upper beam 230. This is for the purpose of providing clearance below the panel support beam 234 in order to provide space for the insulation 260 to be positioned there under, and further, each base clip 226 has the capability to flex to accommodate expansion and contraction of the roof panels 220.

Figure 18:
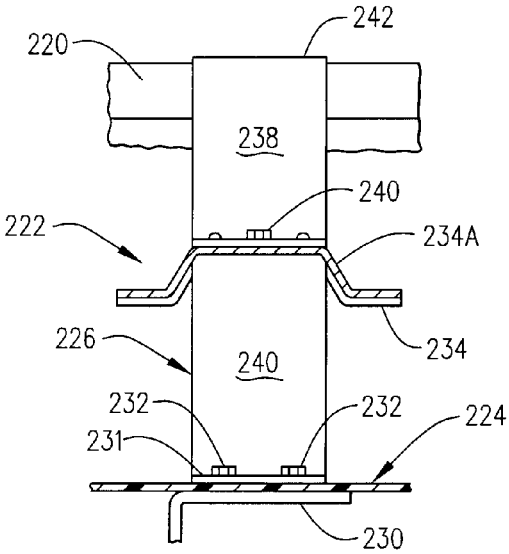
FIG. 18 is an elevational front view of a roof support system shown in FIG. 17.
Figure 19:
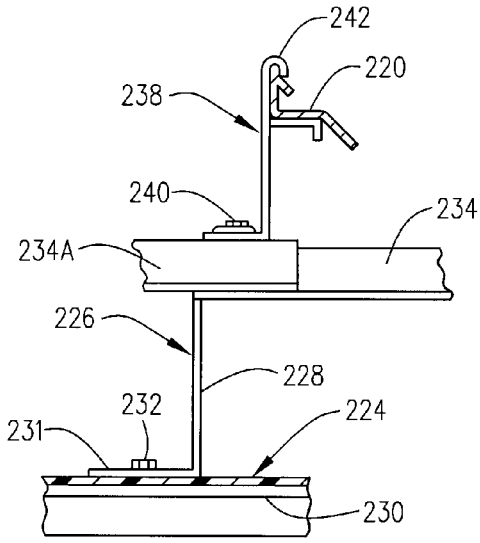
FIG. 19 is an elevational side view of the roof support system of FIG. 18.

The roof panels 220 are secured to the panel support beams 234 and rest on, and are connected to, upper support surfaces 236 thereof which provide support for the medial portions of the roof panel 220 members for both inwardly and outwardly directed load. As shown in FIGS. 18 and 19 (which show only the male sidelap joint of one roof panel 220 in order to display the clip), an upwardly extensive clip member 238 is secured to the upper support surface 236 of the overlapped panel support beams 234 and panel support beams 234A via a screw 240. An upper hook portion 242 of the clip member 238 is formed to hook over the apex portion of the male sidelap joint of the roof panel 220.

Once the flexible membrane 224 is tautly secured to selected anchoring points and stretched over the support spacers 226, the base clips 226 are secured in place via the screws 232, and the panel support beams 234 are overlappingly aligned along each of the support spacers 226. The standing seam roof panels 220 are snapped into overlapping and interlocking relationship over the clip member 238.

Another unique and advantageous feature of the clip member 238, as shown in FIG. 19, is that the screw 240 connecting the clip member 238 to its underlying support structure is located close to the web.

Figure 20:
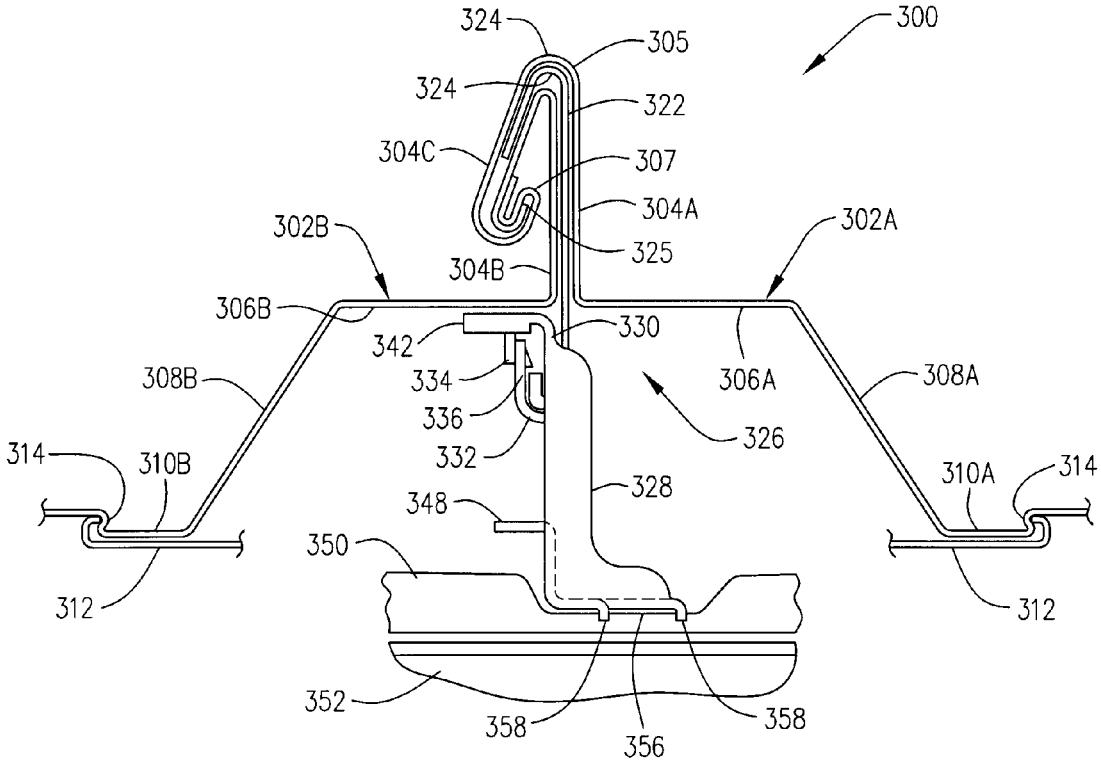
FIG. 20 is an elevational view of the standing seam assembly with adjacent roof panels.

Referring now to FIG. 20, shown therein is a standing seam assembly 300 with adjacent roof panels 302A and 302B, respectively, assembled in accordance with the present invention. The standing seam assembly 300 of FIG. 20 is of the interlocking variety, wherein a female and a male sidelap joint 304A and 304B are aligned and snapped into place during assembly in a manner similar as that described hereinabove. Further, the standing seam assembly 300 is provided with corrugation sections including first horizontal portions 306A and 306B, angled portions 308A and 308B and second horizontal portions 310A and 310B.

FIG. 20 shows the standing seam assembly 300 after completion of field installation. The leg portion 304C of the female sidelap joint 304A is formed so as to be disposed in near proximity to the male sidelap joint 304B following the contours thereof and sandwiching the mastic material 324 at the top or apex 305 of the standing seam assembly 300, as shown, to provide a weathertight seal. (While shown at the apex 305, it will be understood that the mastic 324 can be disposed at other convenient locations within the standing seam assembly 300 in the manner described elsewhere herein for other standing seam assemblies.)

The leg portion 304C of the female sidelap joint 304A extends angularly from the apex 305 and is sized so that the edge of the leg portion 304C forms a retaining groove 307, with a portion of the edge extending away from the apex of the standing seam, and the retaining groove 307 opening away from the upstanding portions of the sidelap joints 304A, 304B, or that is, generally toward the roof panel 302B. The leg portion 304C may be shortened or lengthened as desired so that rollout material of the edge loops back on itself to extend toward the apex 305, as shown. The radiused portion 324 of the male sidelap joint 304B extends away from the apex 305 to a point within the cavity of the female sidelap joint 304A where it is bent back over itself to extend toward the apex 305, there forming a locking tab 325.

In the assembled mode of the standing seam assembly 300, the locking tab 325 extends into the retaining groove 307, as shown, in such a manner that, as uplift forces tend to disengage and open the standing seam assembly 300, the locking tab 325 (the formed edge of the male sidelap joint 304B) locks within the retaining groove 307 (the formed edge of the female sidelap joint 304A) to keep the sidelap joints 304A and 304B in engagement. That is, as the panels 302A and 302B are subjected to uplift forces, pivoting disengagement is attempted by the separation of these members at the apex 305, and as this occurs, the locking tab 325 and retaining groove 307 permit some upward flexing of the panels 302A, 302B while maintaining the latching integrity of the sidelap joints 304A, 304B and closure of the standing seam assembly 300.

Figure 21:
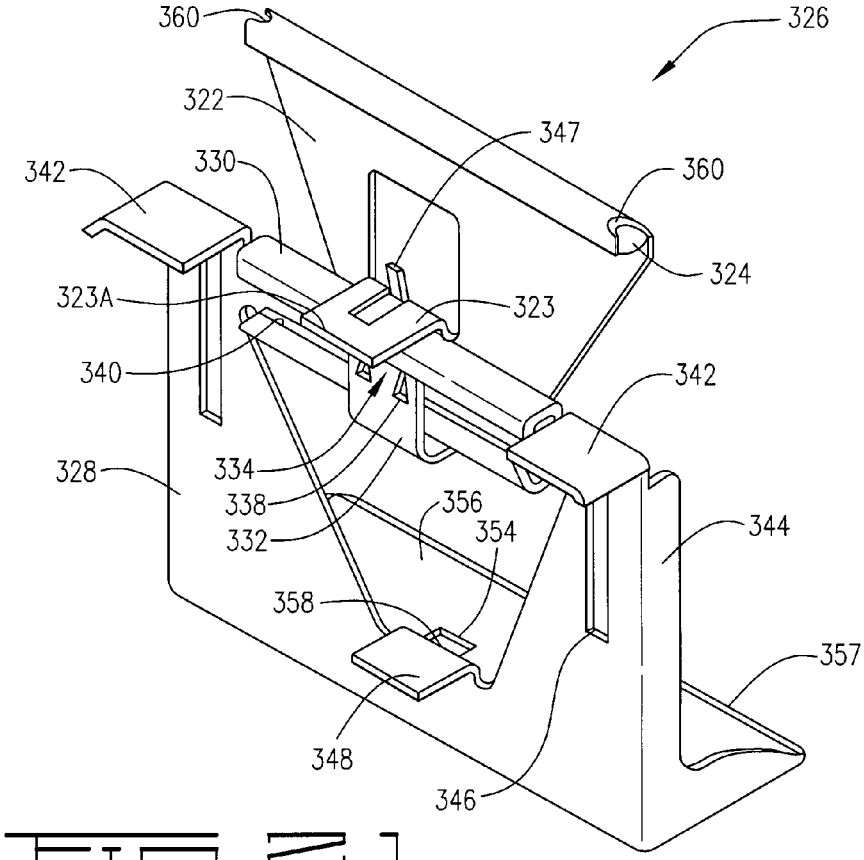
FIG. 21 is a perspective view of the clip base.

As with other standing seam assemblies described hereinabove, the standing seam assembly 300 is provided with a horizontal clip 312, shown in cut-away fashion in FIG. 20, which secures the roof panels 302A and 302B. FIG. 20 shows the horizontal clip 312 in near proximity to and supported by clip contact surfaces 314 provided within the second horizontal portions 310A and 310B. FIG. 21 shows an enlarged view of the horizontal clip 312 and the clip contact surface 314 for the right side of the horizontal clip 312. A knurled clip retention surface 316 may be provided at the edge of the horizontal clip 312 for improved contact between the horizontal clip 312 and the clip contact surface 314.

Returning to FIG. 20, the standing seam assembly 300 is shown to include a hold down clip 322 that hooks over a radiused portion 324 of the male sidelap joint 304B and passes through mastic material 324 that is provided above the radiused portion 324. The mastic material 324, in providing a weathertight seal also contacts the hold down clip 322. If relative movement between the hold down clip 322 and the radiused portion 324 occurs, the sealant dam may be broken. Therefore, to prevent relative movement between the hold down clip 322 and the radiused portion 324 of the male sidelap joint 304B, a two piece floating clip has been used. More particularly, the mastic material 324 is provided both on the interior side of the female sidelap joint 304A and the interior side of the hold down clip 322, so that once the standing seam assembly 300 is assembled the mastic material 324 is sandwiched onto both sides of the hold down clip 322 to provide a weathertight seal. Additionally, as it is contemplated that the hold down clip 322 will not run the entire length of the standing seam assembly 300, but rather only be provided at selected locations along the seam, the mastic material 324 provided on the interior side of the female sidelap joint 304A will provide a weathertight seal between the interior side of the female sidelap joint 304A and the radiused portion 324 of the male sidelap joint 304B.

To accommodate expansion and contraction of the roof panels 302A and 302B relative to the building structure, a two-piece hold down clip assembly 326 is utilized, which comprises the aforementioned hold down clip 322 as well as a clip base 328 to which the hold down clip 322 is attached. The clip base 328 is shown in FIGS. 20 and 21 and is more fully illustrated with reference to FIGS. 22 and 23.

Referring to FIG. 20 and to FIG. 21, the clip base 328 is shown to comprise a C-shaped beam section 330, which supports a hook-shaped section 332 of the hold down clip 322. More particularly, the hook-shaped section 332 of the hold down clip 322 extends under and around the C-shaped beam section 330 and is provided with a first tab 334 that slidably engages on an interior surface 336 of the C-shaped beam section 330, as shown. The first tab 334 limits the lateral travel of the hold down clip 322, holding the hold down clip in an essentially vertical attitude. Additionally, the hook-shaped section 332 of the hold down clip 322 is provided with a second tab 338 that rests on a top surface 340 of the C-shaped beam section 330, which serves to support the hold down clip 322 and to limit its vertical movement. Thus, the first and second tabs 334 and 338 serve to secure the hold down clip 322 from movement in the vertical direction, while allowing the hold down clip 322 to move longitudinally as the hook-shaped section 332 slides along the C-shaped beam section 330. An enlarged view of this portion of the two-piece hold down clip assembly 326 is provided in FIG. 23.

The clip base 328 is shown to further comprise seats 342, which support the horizontal portion 306B of the roof panel 302B. The clip base 328 may be formed from a single piece of sheet metal formed as shown so as to include rib sections 344 and embossments 346 to provide additional strength and resistance to distortional forces upon the clip base 328.

During installation, the hold down clip 322 should be centered to assure the full range a movement. This is accomplished by a locking tab 347 that is formed in the hold down clip 322 such that an indent in the C-shaped beam section 330 is engaged by the locking tab 347 until the locking tab 347 is positioned over the male leg of the panel at which time the locking tab 347 is pushed away from the C-shaped beam section 330, thus freeing the hold down clip 322 to slide along the C-shaped beam section 330.

The hold down clip 322 further has a lower shelf 323 which is formed to slide under the male side lap joint 304B. The lower shelf 323 is formed at an angle that results in a leading edge 323A of the lower shelf 323 having to be deflected by about 15 degrees to slide under the male sidelap joint 304B. The deflection of the lower shelf 323 results in a continuous force being applied to the lower portion of the male sidelap joint, thus forcing the radiused portion 324 of the male sidelap joint 304B into the mastic material 324 contained under the hold down clip 322. This will assure that the male side lap joint 304B will be held firmly against the mastic material 324 throughout the life of the roof system.

The clip base 328 further comprises an insulation tab 348 useful in securing a foam block insulation strip (not shown) that may be placed over a layer of thermal insulation 350. The foam insulation strip will be sized to a width that will fit between the reinforcing seats 342 on the previously installed clip base and will be of a length that will allow the insulation tab 348 to embed into the opposite end of the foam block as the clip is being installed, thus capturing both ends of the foam block. This will hold the foam block in position as the panels expand and contract.

Figure 22:
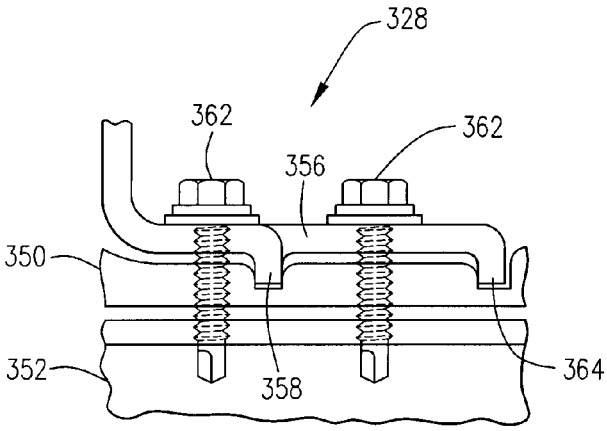
FIG. 22 is an enlarged view of the base of the hold down clip on FIG. 21.
Figure 23:
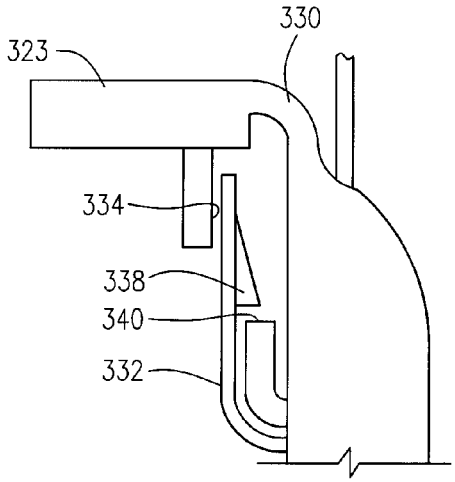
FIG. 23 is an enlarged view of a two-piece hold down clip assembly.

The base of the clip base 328 is anchored to the underlying structure, such as a purlin 352 using conventional hardware, such as screws 362 shown in FIG. 22. More particularly, FIG. 22 shows that the clip base 328 may be attached to the underlying structure by means of the screws 362 through a flange portion 356. To provide a solid connection of the base over the thermal insulation 350, the flange portion 356 is formed with feet 358 that extend downwardly at an angle normal to the flange portion 356 and which easily compress the thermal insulation 350 so as to bear solidly on the purlin 352. The feet 358 are formed by punching square holes 354 through the flange portion 356 and forming opposing sides of the square downward. Additionally, a back edge 357 of the flange portion 356 is formed downwardly to provide a foot surface 364 that acts in cooperation with the feet 358 to support the flange portion 356.

Finally, returning to the discussion concerning the mastic material 324 used to provide a weathertight seal between the hold down clip 322, the interior side of the female sidelap joint 304A and the radiused portion 324 of the male sidelap joint 304B, a notch 360 in each end of the hold down clip 322 is shown in FIG. 21. The notch 360 provides a V-shaped cutaway at the end of the hold down clip 322, beyond which the mastic material 324 attached to the interior side of the hold down clip 322 extends, as shown. The purpose for the notch 360 is to provide a structure that will carry sufficient mastic material 324 to bridge between mastic material 324 carried by the underside of female sidelap joint 304A and the radiused portion 324 of the male sidelap joint 304B when in the assembled position. That is the mastic material 324 will remain positioned under the notch 360 until the hold down clip 322 is positioned over the male sidelap joint 304B, at which time the mastic material carried by the end or the hold down clip 322 bridging the edges of the notch 360 will be extruded up, forming a sealant nodule that will easily join with the mastic material 324 in the female sidelap joint 304A.

It is clear that the present invention is well adapted to carry out the objects and to attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A standing seam roof assembly comprising:

a first panel with a male sidelap having a male first leg and a male second leg extending from the first male leg, and a male locking tab extending from the male second leg; and a second panel with a female sidelap having a female first leg and a female second leg extending substantially normal from the female first leg and forming therewith a female first cavity, the female sidelap having a female third leg extending from the female second leg forming therewith a female second cavity and a female hook leg extending from the female third leg forming therewith a female third cavity, the female sidelap and the male sidelap overlapped so that the female first leg and male first leg are substantially parallel, the female second leg and the male second leg are substantially parallel, and the female third leg and the male locking tab are substantially parallel, the male first leg and male second leg disposed in the female first cavity, the male second leg disposed in the female second cavity, and the male locking tab disposed in the female third cavity.

2. The roof assembly of claim 1 further comprising clip means for connecting male sidelap to the support structure.

3. The roof assembly of claim 2 wherein the clip means comprises:

a clip first leg disposed between the female first leg and the male first leg;

a clip second leg disposed between the female second leg and the male second leg; and a clip locking tab disposed between the female third leg and the male locking tab, the end of the clip locking tab disposed in the female third cavity.

4. A standing seam roof assembly comprising:

a first panel with a male sidelap having male first and second legs and a male locking tab;

a second panel with a female sidelap having a female first and second legs substantially normal to each other and forming a female first cavity, having a female third leg forming a female second cavity with the female second leg, and having a female hook leg forming a female third cavity with the female third leg; and wherein the female sidelap and the male sidelap are hook and rolled to interconnect so as to be overlapped so that the female first leg and the male first leg are substantially parallel, the female second leg and the male second leg are substantially parallel, the female third leg and the male locking tab are substantially parallel;

whereas the junction of the male first and second legs is disposed in the female first cavity, the junction of the male second and third legs is disposed in the female second cavity, and the end of the male locking tab is disposed in the female third cavity; and whereas the female third leg and male locking tab are formed to extend together toward the female and male first legs.

5. The roof assembly of claim 4 further comprising clip means for connecting the male sidelap to the support structure.

6. The roof assembly of claim 5 wherein the clip means comprises a clip first leg disposed between the female first leg and the male first leg;

a clip second leg disposed between the female second leg and the male second leg; and a clip locking tab disposed between the female third leg and the male locking tab, the end of the clip locking tab disposed in the female third cavity.

7. A standing seam comprising:

a male sidelap having male first and second legs and a male locking tab;

a female sidelap having female first and second legs substantially normal to each other and forming a female first cavity, having a female third leg forming a female second cavity with the female second leg, and having a female hook leg forming a female third cavity with the female third leg; and wherein the female sidelap and the male sidelap are hook and rolled to interconnect so as to be overlapped so that the female first leg and the male first leg are substantially parallel, the female second leg and the male second leg are substantially parallel, the female third leg and the male locking tab are substantially parallel;

whereas the junction of the male first and second legs is disposed in the female first cavity, the junction of the male second and third legs is disposed in the female second cavity, and the end of the male locking tab is disposed in the female third cavity; and whereas the female third leg and male locking tab are formed to extend together toward the female and male first legs.

8. The standing seam of claim 7 further comprising clip means for connecting the male sidelap to the support structure.

9. The standing seam of claim 8 wherein the clip means comprises:

a clip first leg disposed between the female first leg and the male first leg;

a clip second leg disposed between the female second leg and the male second leg; and a clip locking tab disposed in the female third cavity.

10. A method of installing a roof assembly in which adjacent panel sidelaps in overlapping edge relationship to form a standing seam, comprising the steps of:

positioning a female sidelap that has a female first leg, a female second leg extending substantially normal to the female first leg, a female third leg extending from the second leg and forming a female retention cavity at the end thereof;

positioning a male sidelap that has a male first leg, a male second leg extending substantially normal to the male first leg, and a male locking tab extending from the second leg;

hooking the male locking tab in the retention cavity as the female sidelap overlaps the male sidelap so that the male sidelap has an upwardly directed force as the male sidelap is rotated, the female and male sidelaps elastically overlapped with the female and male first legs being substantially parallel, the female and male second legs being substantially parallel, and the female third leg and the male locking tab being substantially parallel.

11. The method of claim 10 further comprising the step of:

seam forming the female and male sidelaps so that the female third leg and male locking tab extend together toward the female and male first legs.

12. The method of claim 11 further comprising the step of:

seam forming the female and male sidelaps so that the female third leg and the male locking tab extend in an upwardly inclined direction toward the female and male first legs.

13. The method of claim 12 further comprising the step of:

positioning a clip member so that a first clip leg is disposed between the female first leg and the male first leg, a clip second leg is disposed between the female second leg and the male second leg, and a clip locking tab is disposed in the female third cavity.

* * * * *